US007642992B2

(12) United States Patent
Rhee et al.

(10) Patent No.: US 7,642,992 B2
(45) Date of Patent: Jan. 5, 2010

(54) PLASMA DISPLAY APPARATUS AND DRIVING METHOD THEREOF

(75) Inventors: Byungho Rhee, Gumi-si (KR); Yunkwon Jung, Gumi-si (KR); Gun Su Kim, Seongnam-si (KR); Yong Song, Gumi-si (KR)

(73) Assignee: LG Electronics Inc., Seoul (KR)

( * ) Notice: Subject to any disclaimer, the term of this patent is extended or adjusted under 35 U.S.C. 154(b) by 695 days.

(21) Appl. No.: 11/256,992

(22) Filed: Oct. 25, 2005

(65) Prior Publication Data

US 2007/0008245 A1 Jan. 11, 2007

(30) Foreign Application Priority Data

Jul. 5, 2005 (KR) ..... 10-2005-0060486
Aug. 8, 2005 (KR) ..... 10-2005-0072522

(51) Int. Cl.
*G09G 3/28* (2006.01)

(52) U.S. Cl. ..... 345/60; 345/63; 345/204

(58) Field of Classification Search ..... 345/60, 345/63, 204

See application file for complete search history.

(56) References Cited

U.S. PATENT DOCUMENTS 6,404,411 B1 * 6/2002 Masuda et al. ..... 345/66
7,023,404 B2 * 4/2006 Huang ..... 345/60
2006/0022967 A1 * 2/2006 Hirakawa et al. ..... 345/204

FOREIGN PATENT DOCUMENTS

KR 10-2005-0049076 A 5/2005

* cited by examiner

*Primary Examiner*—Richard Hjerpe
*Assistant Examiner*—Leonid Shapiro
(74) *Attorney, Agent, or Firm*—KED & Associates LLP

(57) ABSTRACT

The present invention relates to a plasma display apparatus, and more particularly, to a plasma display apparatus and driving method thereof, in which an afterimage erroneous discharge generated when the apparatus is driven can be prevented and damage to driving circuits can be prevented. The plasma display apparatus of the present invention comprises a plasma display panel in which a plurality of sustain electrode pairs comprising scan electrodes and sustain electrodes is formed, a driver for driving the sustain electrode pairs, and a driving pulse controller that controls the driver to sequentially apply first and second falling waveforms to the scan electrodes during a reset period, and controls the driver to apply a positive waveform whose voltage level is less than the voltage level of a sustain waveform to the sustain electrodes while the first falling waveform is applied. According to the present invention, an afterimage erroneous discharge can be prevented. Spots in an implemented monochromatic pattern can be improved. A distortion phenomenon of a display screen can be prevented. Hardware load cam be reduced by reducing EMI generating when a plasma display apparatus is driven. In addition, a complementary afterimage of implemented images can be prevented.

21 Claims, 13 Drawing Sheets

PLASMA DISPLAY APPARATUS AND DRIVING METHOD THEREOF

CROSS-REFERENCES TO RELATED APPLICATIONS

This Nonprovisional application claims priority under 35 U.S. C. § 119(a) on Patent Applications Nos. 10-2005-0060486 and 10-2005-0072522 filed in Korea on Jul. 5, 2005 and Aug. 8, 2005, the entire contents of which are hereby incorporated by reference.

BACKGROUND OF THE INVENTION

1. Field of the Invention

The present invention relates to a plasma display apparatus, and more particularly, to a plasma display apparatus and driving method thereof, in which an afterimage erroneous discharges generated when the apparatus is driven are prevented and damage to driving circuits is prevented.

2. Background of the Related Art

In general, a plasma display apparatus comprises a plasma display panel having a front substrate and a rear substrate. A barrier rib formed between the front substrate and the rear substrate forms one unit cell. Each cell is filled with a primary discharge gas, such as neon (Ne), helium (He) or a mixed gas of Ne+He, and an inert gas containing a small amount of xenon (Xe). If the inert gas is discharged with a high frequency voltage, vacuum ultraviolet rays are generated. Phosphors formed between the barrier ribs are excited to implement images. This plasma display panel can be manufactured to be thin, and has been considered one of the next-generation display devices.

FIG. 1 shows the construction of a common plasma display panel.

The plasma display panel comprises a front panel 100 and a rear panel 110. In the front panel 100, a plurality of sustain electrode pairs in which a plurality of scan electrodes 102 and sustain electrodes 103 are formed in pairs are arranged on a front glass 101, i.e., a display surface on which images are displayed. In the rear panel 110, a plurality of address electrodes 113 intersecting the plurality of sustain electrode pairs are arranged on a rear glass 111, i.e., a rear surface. The front panel 100 and the rear panel 110 are parallel to each other with a predetermined distance therebetween.

The front panel 100 comprises the pairs of scan electrodes 102 and sustain electrodes 103, which mutually discharge one another and maintain the emission of a cell within one discharge cell. In other words, the scan electrode 102 and the sustain electrode 103 has a transparent electrode "a" formed of a transparent ITO material and a bus electrode "b" formed of a metal material. The scan electrodes 102 and the sustain electrodes 103 are covered with one or more dielectric layers 104 for limiting the discharge current and providing insulation among the electrode pairs. A protection layer 105 having magnesium oxide (MgO) deposited thereon is formed on the dielectric layers 104 to facilitate a discharge condition.

In the rear panel 110, barrier ribs 112 of stripe form (or well form), for forming a plurality of discharge spaces, i.e., discharge cells are arranged parallel to one another. One or more address electrodes 113, which cause an inert gas within a discharge cell to generate vacuum ultraviolet rays through an address discharge, are disposed parallel to the barrier ribs 112. R, G and B phosphor layers 114 that radiate a visible ray for image display during a sustain discharge are coated on a top surface of the rear panel 110. A dielectric layer 115 for protecting the address electrodes 113 is formed between the address electrodes 113 and the phosphor layers 114.

In the plasma display panel constructed above, the discharge cell is formed in plural in matrix form. A driver (not shown) comprising a driving circuit for supplying a predetermined pulse to the discharge cell is attached to the plasma display panel.

FIG. 2 illustrates a method of implementing images of a conventional plasma display apparatus.

As shown in FIG. 2, in the plasma display apparatus, one frame period is divided into a plurality of sub-fields, each sub-field having a different number of discharges. The plasma display panel is excited in a sub-field period corresponding to a gray level value of an input image signal, thereby implementing images.

Each sub-field is divided into a reset period for uniformly generating a discharge, an address period for selecting a discharge cell and a sustain period for implementing gray levels depending on the number of discharges. For example, to display images with 256 gray levels, a frame period (16.67 ms) corresponding to 1/60 seconds is divided into eight sub-fields, as shown in FIG. 2.

Each of the eight sub-fields SF1 to SF8 is again divided into a reset period, an address period and a sustain period. In this case, the sustain period increases in the ratio of $2^n$ (where, n=0, 1, 2, 3, 4, 5, 6, 7) in each sub-field. As described above, since the sustain period is varied in each sub-field, gray levels of images can be represented.

The driving principle of the plasma display apparatus constructed above will be described with reference to FIGS. 3*a* and 3*b*.

FIG. 3*a* shows a driving waveform of the conventional plasma display apparatus.

As shown in FIG. 3, the plasma display apparatus is driven with it being divided into a reset period for initializing the entire cells, an address period for selecting cells to be discharged, a sustain period for sustaining the discharge of selected cells and an erase period for erasing wall charges within discharged cells.

In a set-up period of the reset period, a set-up waveform forming a rising ramp (Ramp-up) is applied to all of the scan electrodes at the same time. The set-up waveform generates a weak dark discharge within the discharge cells of the entire screen. The set-up discharge causes positive wall charges to be accumulated on the address electrodes and the sustain electrodes, and negative wall charges to be accumulated on the scan electrodes.

In a set-down period of the reset period, after the set-up waveform is applied, a set-down waveform forming a falling ramp (Ramp-down), which falls from a voltage level lower than the highest voltage level of the set-up discharge to a predetermined negative voltage level, is applied to the scan electrodes. Since a weak erase discharge is generated within cells, wall charges excessively formed on the scan electrodes are sufficiently erased. The set-down discharge causes wall charges of the degree in which an address discharge can be stably generated to uniformly remain within the cells.

In the address period, while a scan waveform forming a negative waveform is sequentially applied to the scan electrodes, an address waveform forming a positive waveform is applied to the address electrodes in synchronization with the scan waveform. As the voltage difference between the scan waveform and the address waveform and a wall voltage generated in the reset period are added, an address discharge is generated within the discharge cells to which the address waveform is applied.

Wall charges of the degree in which a sustain discharge can be generated when a sustain waveform is applied are formed within cells selected by the address discharge. The sustain electrode is supplied with a waveform having a positive bias voltage (Vzb) such that an erroneous discharge is not generated between the sustain electrode and the scan electrodes by reducing a voltage difference between the sustain electrode and the scan electrodes during the address period.

In the sustain period, a sustain waveform (sus) forming a positive waveform is alternately applied to the scan electrodes and the sustain electrode. As a wall voltage within the cells and a voltage of the sustain waveform are added together, a sustain discharge, i.e., a display discharge is generated between the scan electrode and the sustain electrode in cells selected by the address discharge whenever the sustain waveform is applied.

After the sustain discharge is completed, in the erase period, an erase waveform (Ramp-ers) having a narrow pulse width and a low voltage level are applied to the sustain electrodes, thereby erasing wall charges remaining within the cells of the entire screen.

Wall charges that are distributed within a discharge cell by this driving waveform will be described with reference to FIG. 3*b*.

FIG. 3*b* illustrates wall charges distributed within a discharge cell according to the conventional driving waveform.

Referring to FIG. 3*b*, in the set-up period of the reset period, the set-up waveform is applied to the scan electrode Y and a waveform of a voltage level lower than that of the set-up waveform is applied to the sustain electrode Z and the address electrode X. Therefore, as shown in (a) of FIG. 3*b*, negative charges are located on the scan electrode Y and positive charges are located on the sustain electrode Z and the address electrode X.

In the set-down period, the set-down waveform is supplied to the scan electrode Y, and a predetermined bias voltage, preferably, a voltage of a ground (GND) level is supplied to the sustain electrode Z and the address electrode X and then maintained. Therefore, wall charges that are excessively accumulated within the discharge cell in the set-up period are partially erased, as shown in (b) of FIG. 3*b*. Through this erase process, distribution of wall charges within each discharge cell becomes irregular.

In the address period, an address discharge is generated as shown in (c) of FIG. 3*b* by means of the scan waveform supplied to the scan electrode Y and the address waveform supplied to the address electrode X.

Thereafter, in the sustain period, the sustain waveforms are alternately applied to the scan electrode Y and the sustain electrode Z, so that the sustain discharge is generated as shown in (d) of FIG. 3*b*.

In the prior art, wall charges formed in the set-up period are erased mainly between the scan electrode Y and the address electrode X during the set-down period. Most of the wall charges formed between the scan electrode Y and the sustain electrode Z remain.

In the prior art, R (Red), G (Green) and B (Blue) cells form one unit pixel. When at least one cell of the unit pixel remains off when the apparatus is driven, charged particles diffuse from adjacent cells to cells that remain off. In this case, when the R (Red), G (Green) and B (Blue) cells form one unit pixel and at least one cell of the unit pixel remains off upon driving, the unit pixel forms a monochromatic pattern in a screen that is being implemented.

When the unit pixel forms the monochromatic pattern, a cell that remains off must not be turned on. Nevertheless, an erroneous discharge is generated between the scan electrode Y and the sustain electrode Z during the address period by charged particles diffused from cells adjacent to adhered wall charges during the set-down period. This is called an "afterimage erroneous discharge". In the conventional plasma display apparatus, an afterimage erroneous discharge during the address period is connected to the sustain period and a sustain discharge is sustained. Therefore, a problem arises because spots are generated.

In the case where a waveform for erasing adhered wall charges is applied, there is a high probability that a discharge may be generated due to excessive wall charges formed in the set-up period. Therefore, a problem in that a distortion phenomenon of the display screen can occur must be taken into consideration.

SUMMARY OF THE INVENTION

Accordingly, the present invention has been made in view of the above problems occurring in the prior art, and it is an object of the present invention to provide a plasma display apparatus, in which it can prohibit an afterimage erroneous discharge by improving the plasma display apparatus and driving method thereof.

It is another object of the present invention is to provide a plasma display apparatus, that can improve a spot problem in a monochromatic pattern that is implemented by improving the plasma display apparatus and the driving method thereof.

It is yet another object of the present invention to provide plasma display apparatus, that can prevent a distortion phenomenon of a display screen, which is incurred by a pulse applied to improve the above objects.

It is still another object of the present invention to provide a plasma display apparatus, that can prevent damage to the driving circuits by Electromagnetic Interference (EMI).

To achieve the above objects, a plasma display apparatus according the present invention comprises a plasma display panel in which a plurality of sustain electrode pairs comprising scan electrodes and sustain electrodes is formed, a driver for driving the sustain electrode pairs, and a driving pulse controller that controls the driver to sequentially apply first and second falling waveforms to the scan electrodes during a reset period, and controls the driver to apply a positive waveform whose voltage level is lower than the voltage level of a sustain waveform to the sustain electrodes while the first falling waveform is applied.

A plasma display apparatus according the present invention comprises a plasma display panel in which a plurality of sustain electrode pairs comprising scan electrodes and sustain electrodes are formed, a driver for driving the sustain electrode pairs, and a driving pulse controller that controls the driver to sequentially apply a first falling waveform and a second falling waveform, which falls at the same voltage level as that of the first falling waveform, to the scan electrodes, during a reset period, and controls the driver to apply a positive waveform whose voltage level is lower than that of a sustain waveform to the sustain electrodes while the first falling waveform is applied.

A plasma display apparatus according the present invention comprises a plasma display panel in which a plurality of sustain electrode pairs comprising scan electrodes and sustain electrodes is formed, a driver for driving the sustain electrode pairs, and a driving pulse controller that controls the driver to sequentially apply first and second falling waveforms to the scan electrodes during a reset period, controls the driver to apply a positive waveform whose voltage level is lower than that of a sustain waveform to the sustain electrodes while the first falling waveform is applied, and controls the sustain electrodes to be floated in at least one period.

A method of driving a plasma display apparatus in which a sustain electrode pair comprising a scan electrode and a sustain electrode, and an address electrode intersecting the sustain electrode pair form one discharge cell according the present invention comprises the steps of (a) applying a set-up waveform to the scan electrode, (b) applying a first falling waveform whose lowest voltage level is a negative polarity to the scan electrode, and while the first falling waveform is applied, applying a positive waveform whose voltage level is lower than that of the sustain waveform to the sustain electrode, and (c) applying a second falling waveform whose lowest voltage level is a negative polarity to the scan electrode, and while the second falling waveform is applied, maintaining the sustain electrode to a ground (GND) level voltage.

The present invention is advantageous in that it can prevent an afterimage erroneous discharge.

The present invention is advantageous in that it can improve spots in an implemented monochromatic pattern.

The present invention is advantageous in that it can prevent a distortion phenomenon of a display screen.

The present invention is advantageous in that it can reduce hardware load by reducing EMI generating when a plasma display apparatus is driven.

The present invention is advantageous in that it can prevent a complementary afterimage of implemented images.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
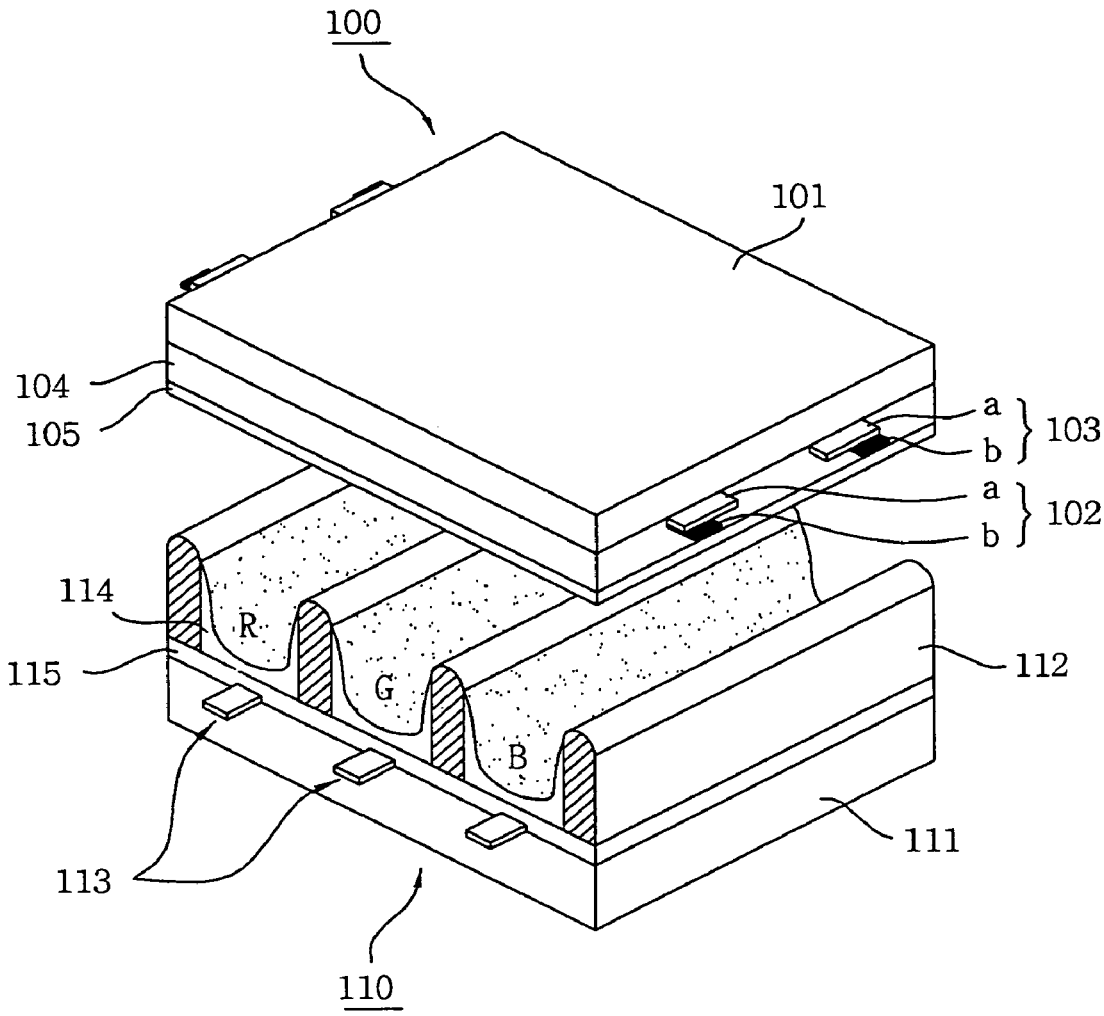
FIG. 1 shows the construction of a common plasma display panel.
Figure 2:
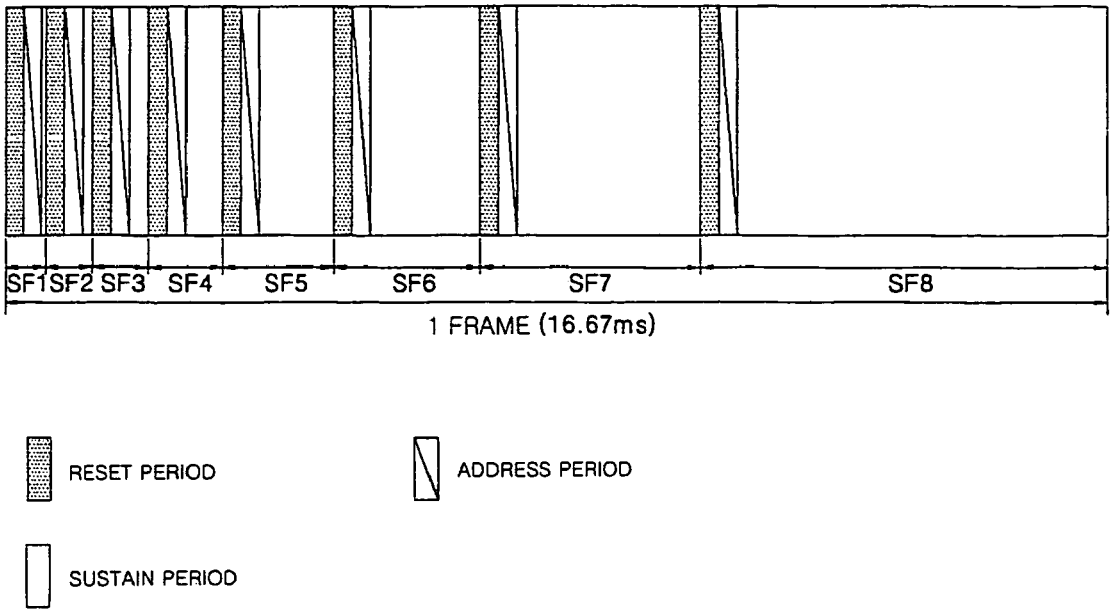
FIG. 2 illustrates a method of implementing images of a conventional plasma display apparatus.
Figure 3A:
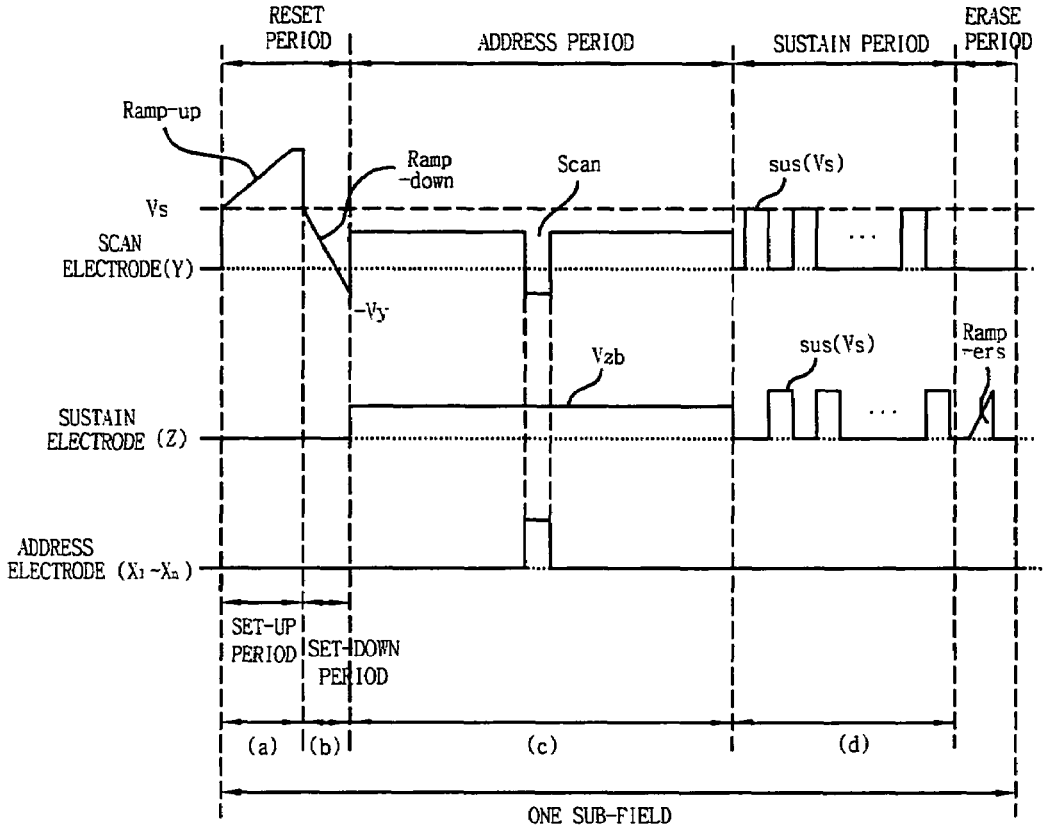
FIG. 3*a* shows a driving waveform of the conventional plasma display apparatus.
Figure 3B:
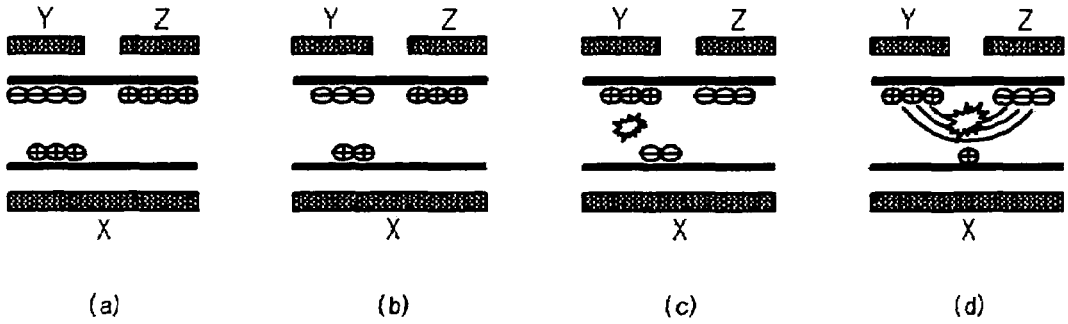
FIG. 3*b* illustrates wall charges distributed within a discharge cell according to the conventional driving waveform.

The present invention will now be described in detail in connection with preferred embodiments with reference to the accompanying drawings.

A plasma display apparatus according the present invention comprises a plasma display panel in which a plurality of sustain electrode pairs comprising scan electrodes and sustain electrodes is formed, a driver for driving the sustain electrode pairs, and a driving pulse controller that controls the driver to sequentially apply first and second falling waveforms to the scan electrodes during a reset period, and controls the driver to apply a positive waveform whose voltage level is lower than that of a sustain waveform to the sustain electrodes while the first falling waveform is applied.

The positive waveform may have the same voltage level as that of a bias voltage applied to the sustain electrodes during an address period.

The voltage level of the positive waveform may be set in the range of 80V to 100V.

The lowest voltage level of each of the first falling waveform and the second falling waveform may be a negative polarity.

The lowest voltage levels of the first falling waveform and the second falling waveform may be different from each other.

The lowest voltage level of the first falling waveform may be higher than the voltage level of the second falling waveform.

An absolute value of the lowest voltage level of the first falling waveform may be set to be less than 70% of the voltage level of the second falling waveform.

During the reset period, the lowest voltage level of the first falling waveform may be controlled according to the highest voltage level of a set-up waveform applied to the scan electrodes.

The lowest voltage level of the first falling waveform may be set in a range of −140V to −100V.

A width of the first falling waveform may be set in a range of 10 μs to 30 μs.

The first falling waveform may be supplied from the same voltage source as the voltage level of the second falling waveform.

The first falling waveform may be supplied in at least one sub-field.

While the second falling waveform is supplied, the sustain electrodes may be maintained at a ground (GND) level voltage.

Prior to the reset period, a positive waveform may be applied to any one of the sustain electrode pairs, and a waveform having an opposite waveform to the positive waveform is applied to the remaining electrodes of the sustain electrode pairs.

The lowest voltage level of the first falling waveform in a sub-field comprising the pre-reset period may be different from the voltage level in at least one of the remaining sub-fields.

The highest voltage level of a set-up waveform in a sub-field comprising the pre-reset period may be different from the voltage level in at least one of the remaining sub-fields.

A plasma display apparatus according the present invention comprises a plasma display panel in which a plurality of sustain electrode pairs comprising scan electrodes and sustain electrodes is formed, a driver for driving the sustain electrode pairs, and a driving pulse controller that controls the driver to sequentially apply a first falling waveform and a second falling waveform, which falls at the same voltage level as the voltage level of the first falling waveform, to the scan electrodes, during a reset period, and controls the driver to apply a positive waveform whose voltage level is less than the voltage level of a sustain waveform to the sustain electrodes while the first falling waveform is applied.

The same voltage level may be a ground (GND) level voltage.

While the second falling waveform is applied, the sustain electrodes may be maintained at a ground (GND) level voltage.

A plasma display apparatus according the present invention comprises a plasma display panel in which a plurality of sustain electrode pairs comprising scan electrodes and sustain electrodes is formed, a driver for driving the sustain electrode pairs, and a driving pulse controller that controls the driver to sequentially apply first and second falling waveforms to the scan electrodes during a reset period, controls the driver to apply a positive waveform whose voltage level is less than that of a sustain waveform to the sustain electrodes while the first falling waveform is applied, and controls the sustain electrodes to be floated in at least one period.

The at least one period may be a period where the first falling waveform changes from a ground voltage level to the lowest voltage level or a period where the first falling waveform changes from the lowest voltage level to the ground voltage level.

The driver comprises an energy recovery and supply unit, and the positive waveform is set to rise or fall by the energy recovery and supply unit.

While the second falling waveform is applied, the sustain electrode may be maintained at a ground (GND) level voltage.

A method of driving a plasma display apparatus in which a sustain electrode pair comprising a scan electrode and a sustain electrode, and an address electrode intersecting the sustain electrode pair form one discharge cell, the method comprising the steps of (a) applying a set-up waveform to the scan electrode, (b) applying a first falling waveform whose lowest voltage level is a negative polarity to the scan electrode, and while the first falling waveform is applied, applying a positive waveform whose voltage level is less than that of the sustain waveform to the sustain electrode, and (c) applying a second falling waveform whose lowest voltage level is a negative polarity to the scan electrode, and while the second falling waveform is applied, maintaining the sustain electrode to a ground (GND) level voltage.

First Embodiment

Figure 4:
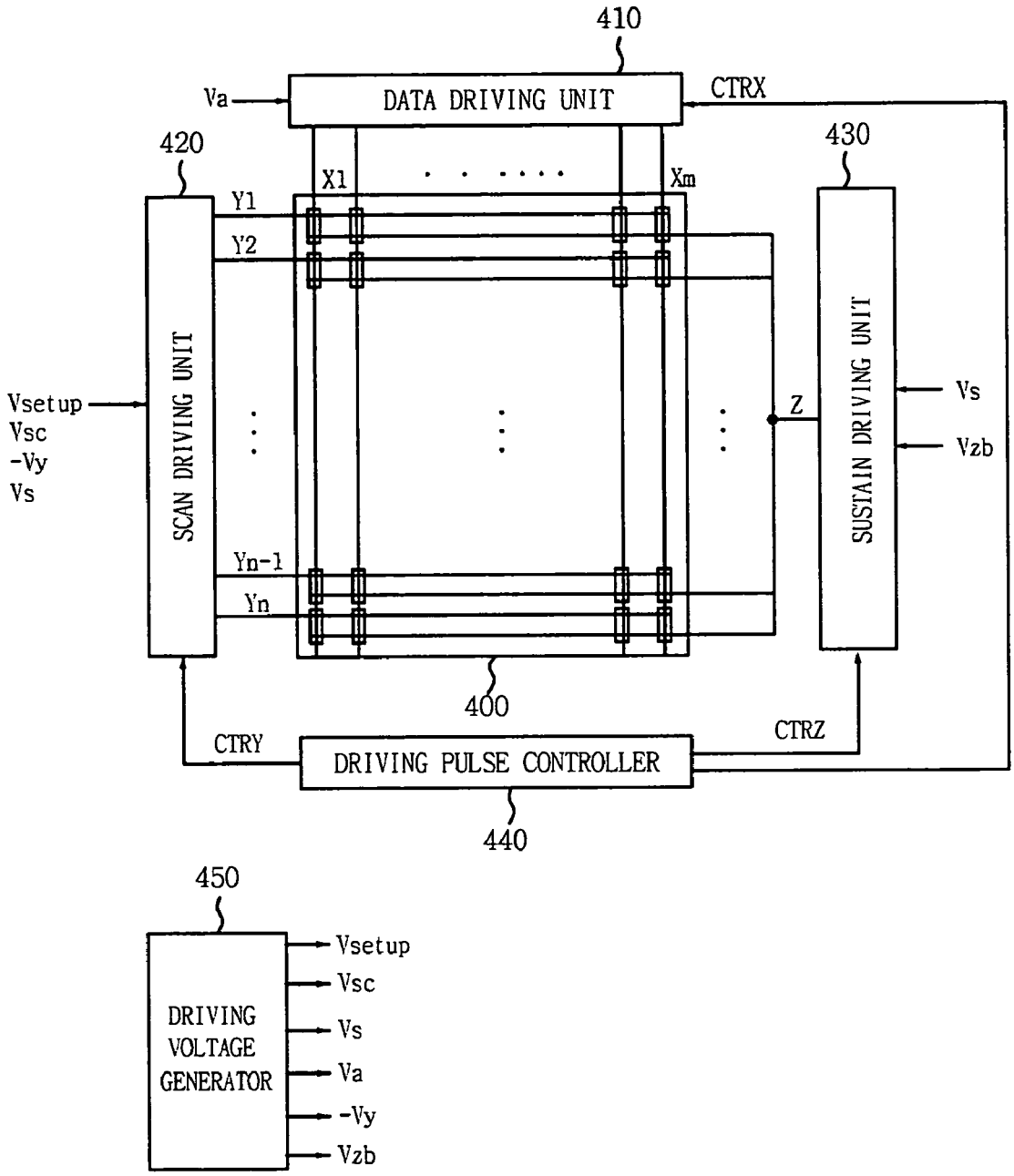
FIG. 4 is a block diagram showing the construction of a plasma display apparatus according to a first embodiment of the present invention.

FIG. 4 is a block diagram showing the construction of a plasma display apparatus according to a first embodiment of the present invention.

As shown in FIG. 4, the plasma display apparatus according to a first embodiment of the present invention comprises a plasma display panel 400, a data driver 410, a scan driver 420, a sustain driver 430, a driving pulse controller 440 and a driving voltage generator 450.

The plasma display panel 400 comprises a front panel (not shown) and a rear panel (not shown) that are attached with a predetermined distance therebetween. Plural pairs of sustain electrode pairs consisting of scan electrodes Y1 to Yn and a sustain electrode Z are formed in the front panel. A plurality of address electrodes X1 to Xm intersecting the scan electrodes Y1 to Yn and the sustain electrode Z is formed in the rear panel.

The data driver 410 supplies data to the address electrodes X1 to Xm formed in the plasma display panel 400. The data supplied is picture signal data that has been processed by a picture signal processor (not shown) that processes externally input picture signals. The data driver 410 samples and latches the data in response to a data timing control signal (CTRX) from the driving pulse controller 440 and supplies an address pulse having an address voltage (Va) to each of the address electrodes X1 to Xm.

The scan driver 420 drives the scan electrodes Y1 to Yn formed in the plasma display panel 400. During a reset period, the scan driver 420 supplies a set-up pulse, which forms a ramp waveform through a combination of a sustain voltage (Vs) and a set-up voltage (Vsetup), to the scan electrodes Y1 to Yn under the control of the driving pulse controller 440.

The scan driver 420 supplies a first falling pulse and a second falling pulse, each constituting a first falling waveform and a second falling waveform, which fall to a negative voltage level, to the scan electrodes Y1 to Yn. The second falling pulse constituting the second falling waveform is a pulse that is the same as the conventional set-down pulse. That is, after the set-up pulse is supplied, a function of uniformly erasing wall charges of all of the discharge cells is performed. In the first embodiment of the present invention, however, before the second falling pulse is supplied, a predetermined falling pulse, i.e., the first falling pulse constituting the first falling waveform is supplied to the scan electrodes Y1 to Yn.

The first falling pulse is a pulse for erasing wall charges that are adhered between the scan electrodes Y1 to Yn and the sustain electrode Z of a cell that remains off. While the first falling pulse is applied to the scan electrodes Y1 to Yn to erase a portion of the wall charges, the sustain driver 430 supplies a pulse forming a positive waveform with a voltage level that is lower than the sustain voltage (Vs) to the sustain electrode Z. This will be described in detail with reference to FIGS. 5*a* to 8 later on.

The scan driver 420 then sequentially supplies a scan pulse, which is supplied from a scan reference voltage (Vsc) to a scan voltage (−Vy), to each of the scan electrodes Y1 to Yn, during an address period. The scan driver 420 then supplies at least one or more sustain pulses for a sustain discharge, which are supplied from a ground (GND) level voltage to a sustain voltage (Vs), to the scan electrodes Y1 to Yn during a sustain period.

The sustain driver 430 drives the sustain electrodes Z, which are common electrodes of the plasma display panel 400. The sustain driver 430 according to a first embodiment of the present invention supplies a positive pulse to the scan electrodes Z while the first falling pulse is applied to the scan electrodes Y1 to Yn under the control of the driving pulse controller 440. The positive pulse has a voltage level of the degree in which a discharge is not generated, i.e., a voltage level lower than the sustain voltage (Vs). Preferably, a voltage shown in the drawing, i.e., the bias voltage (Vzb) supplied to the sustain electrode Z during the address period is used. While the second falling pulse is applied to the scan electrodes Y1 to Yn, the sustain electrode Z is maintained to the ground (GND) level voltage.

The sustain driver 430 also supplies a bias voltage (Vzb) to the sustain electrodes Z during an address period, and supplies at least one sustain pulse for a sustain discharge, which are supplied from the ground (GND) level voltage to the sustain voltage (Vs), to the scan electrodes Z during a sustain period.

The driving pulse controller 440 controls the data driver 410, the scan driver 420 and the sustain driver 430 when the plasma display panel 400 is driven. That is, the driving pulse controller 440 generates timing control signals (CTRX, CTRY and CTRZ) for controlling an operating timing and synchronization of the data driver 410, the scan driver 420 and the sustain driver 430 in the reset period, the address period and the sustain period, and transmits the generated timing control signals (CTRX, CTRY and CTRZ) to the drivers 410, 420 and 430, respectively.

The data control signal (CTRX) comprises a sampling clock for sampling data, a latch control signal, and a switching control signal for controlling an on/off time of an energy recovery circuit and a driving switch circuit within the data driver 410. The scan control signal (CTRY) comprises a switching control signal for controlling an on/off time of an energy recovery circuit and a driving switch circuit within the scan driver 420. The sustain control signal (CTRZ) comprises a switching control signal for controlling an on/off time of an energy recovery circuit and a driving switch circuit within the sustain driver 430.

The driving voltage generator 450 generates driving voltages necessary for the driving pulse controller 440 and the respective drivers 410, 420 and 430, and supplies the generated driving voltages thereto. That is, the driving voltage generator 450 generates the set-up voltage (Vsetup), the scan reference voltage (Vsc), the scan voltage (−Vy), the sustain voltage (Vs), the address voltage (Va) and the bias voltage (Vzb). These driving voltages may be controlled depending on the composition of a discharge gas or the structure of a discharge cell.

The driving waveform implemented by the plasma display apparatus according to a first embodiment of the present invention and a wall charge state within the plasma display panel will be described with reference to FIGS. 5*a* and 5*b*.

Figure 5A:
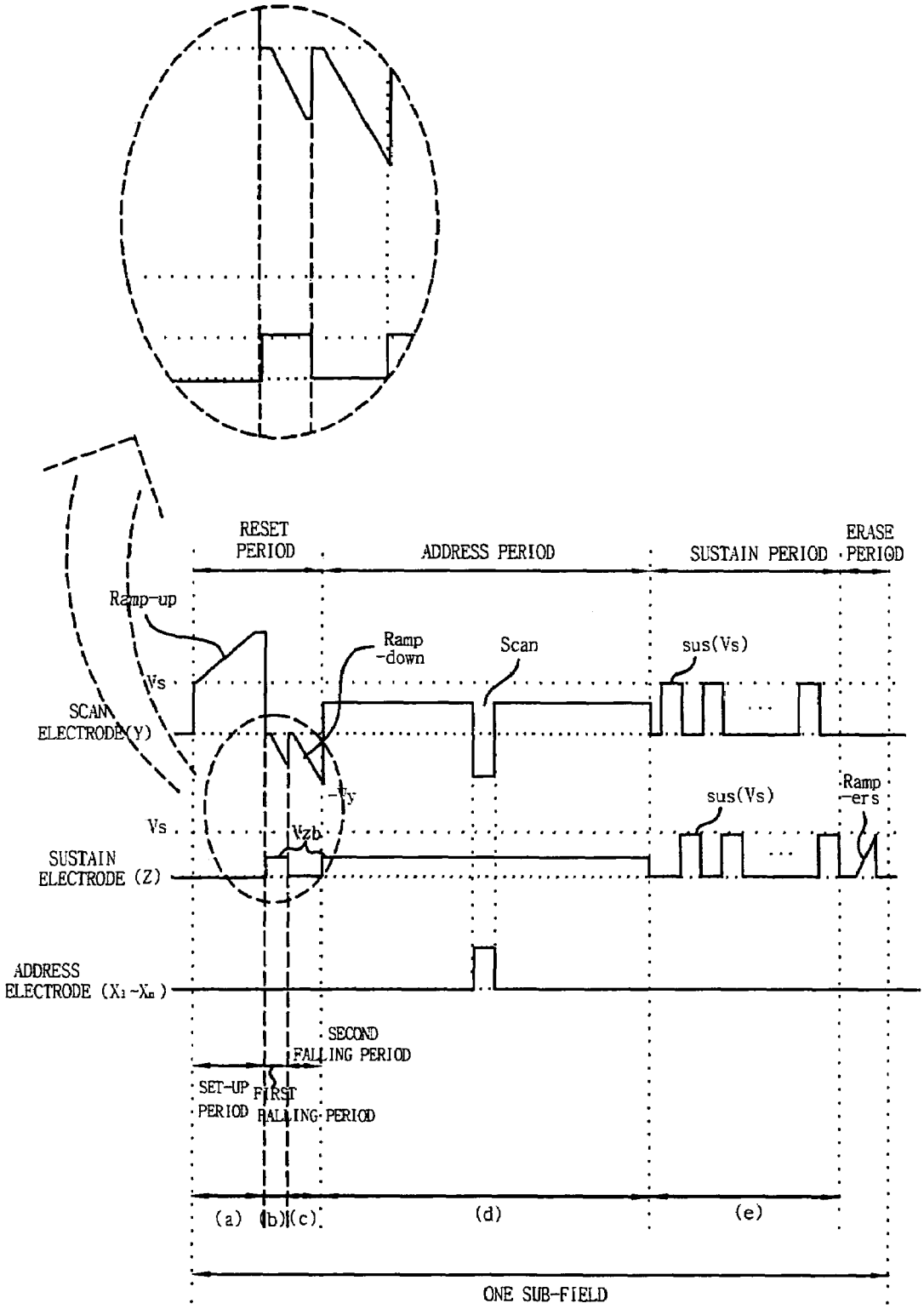
FIG. 5*a* shows a driving waveform of the plasma display apparatus according to a first embodiment of the present invention.

FIG. 5*a* shows a driving waveform of the plasma display apparatus according to a first embodiment of the present invention.

As shown in FIG. 5*a*, the plasma display apparatus according to a first embodiment of the present invention is driven with it being divided into a reset period for initializing the entire cells, an address period for selecting cells to be discharged, a sustain period for sustaining the discharge of selected cells and an erase period for erasing wall charges within discharged cells.

In a set-up period of the reset period, a set-up waveform forming a rising ramp (Ramp-up) is applied to all of the scan electrodes at the same time. The set-up waveform causes a weak dark discharge to be generated within the discharge cells of the entire screen. The set-up discharge causes positive wall charges to be accumulated on the address electrodes and the sustain electrodes, and negative wall charges to be accumulated on the scan electrodes.

In the first embodiment of the present invention, to prevent an afterimage erroneous discharge, wall charges formed between the scan electrodes Y and the sustain electrodes Z are selectively erased. After the set-up waveform is applied to the scan electrodes Y during the set-up period, a negative first falling waveform, which forms a waveform that gradually falls from the ground (GND) level voltage, is supplied to the scan electrodes Y. As the positive waveform is supplied to the sustain electrodes in synchronization with the first falling waveform, a weak erase discharge is generated between the scan electrodes and the sustain electrodes.

As this erase discharge is generated, the plasma display apparatus selectively erases wall charges that are excessively accumulated on cells that remain off. It is thus possible to prevent an erroneous discharge from occurring and to prevent spots from occurring when implementing a monochromatic pattern.

If a positive waveform of a high voltage level, such as a positive waveform having a sustain voltage (Vs), is applied to the sustain electrode to erase adhered wall charges, there is a high probability that a discharge may be generated due to excessive wall charges formed in the set-up period. A strong discharge that is generated extends to a subsequent sustain discharge, which can generate a distortion phenomenon of the display screen.

In a first embodiment of the present invention, a voltage level of the positive pulse is lower than the voltage level of the sustain waveform. During the address period, the bias voltage (Vzb) supplied to the sustain electrode is set to about 80V to 100V, which is lower than the sustain voltage (Vs). For this reason, in a first embodiment of the present invention, the bias voltage source can be preferably used as the voltage source of the positive waveform.

As described above, the positive waveform supplied to the sustain electrode uses the voltage (Vzb) having the same voltage level as the voltage level of the bias pulse applied during the address period. Therefore, an erase discharge can be generated using a voltage difference together with the first falling waveform. That is, by properly controlling the voltage level of the positive waveform, a strong discharge can be prevented from occurring. In addition, since an additional voltage source need not be constructed, the manufacturing costs will be reduced.

The first falling waveform falls from the ground (GND) level voltage to a voltage level of −140V to −100V. If the first falling waveform is less than −140V, a dark afterimage will be generated due to erase light since an erase discharge is excessively generated between the scan electrodes and the sustain electrodes. If the first falling waveform exceeds −100V, an erase discharge may not be generated between the scan electrodes and the sustain electrodes.

The lowest voltage level of the first falling waveform according to a first embodiment of the present invention is varied depending on the highest voltage level of the set-up waveform applied in the set-up period. Since the amount of wall charges accumulated according to the highest voltage level of the set-up waveform is changed, the amount of erased wall charges can be adjusted by controlling the lowest voltage level of the first falling waveform. This will be described in more detail with reference to FIG. 6.

The width of the first falling waveform can be preferably set in the range of 10 μs to 30 μs to secure a sufficient erase discharge time. The width of the first falling waveform refers to a time point at which the first falling waveform falls from the ground voltage level to a time point at which the first falling waveform returns to the ground voltage level.

The first falling waveform according to a first embodiment of the present invention uses a second falling waveform, i.e., the conventional set-down waveform and a voltage supplied form the same voltage source, thereby reducing manufacturing costs. By controlling a switching time of a voltage supplied from the same voltage source, the first falling waveform and the second falling waveform can be implemented.

The first falling waveform according to a first embodiment of the present invention uses the second falling waveform and a voltage of the same voltage source. An absolute value of the lowest voltage level of the first falling waveform is set to be less than 70% of an absolute value of the lowest voltage (−Vy) level of the second falling waveform.

If the absolute value of the lowest voltage level of the first falling waveform exceeds 70% of the absolute value (approximately, 200) of the lowest voltage level of the second falling waveform, erase light generated due to an erase discharge increases between the scan electrodes and the sustain electrodes. More particularly, since cells that remain off have a large quantity of wall charges accumulated thereon compared with cells that remain on and off, such cells have a brightness that is brighter than the erase light of the cells that remain on and off.

Therefore, in a region of an image in which a monochromatic pattern is implemented, a dark afterimage corresponding to a complementary color of monochrome is generated. This is called a "complementary afterimage". In a first embodiment of the present invention, considering the complementary afterimage that may be generated due to the first falling waveform, the lowest voltage level of the first falling waveform is set less than 70% of the absolute value of the lowest voltage level of the second falling waveform, as described above.

In the set-down period of the reset period, a second falling waveform whose voltage level falls from the ground (GND) level voltage to a predetermined voltage (−Vy) level whose lowest voltage level is lower than that of the first falling waveform is applied to the scan electrode. While the second falling waveform is applied to the scan electrode, the sustain electrode keeps the ground (GND) level voltage. Therefore, since an erase discharge is generated between the scan electrode and the address electrodes within the cells, wall charges formed between the scan electrode and the address electrodes are sufficiently erased. The second falling waveform causes wall charges of the degree in which an address discharge can be stably generated to uniformly remain within the cells. That is, the second falling waveform has a similar function as the conventional set-down waveform.

In the address period, while negative scan waveforms are sequentially applied to the scan electrodes, a positive address waveform is applied to the address electrode in synchronization with the scan waveform. As a voltage difference between the scan waveform and the address waveform and a wall voltage generated in the reset period are added together, an address discharge is generated within discharge cells to which the address waveform is applied. Wall charges of the degree in which a discharge can be generated when the sustain waveform of the sustain voltage (Vs) level is applied are formed within cells selected by the address discharge. The sustain electrode is supplied with a waveform having a positive bias voltage (Vzb) such that an erroneous discharge is not generated between the sustain electrode and the scan electrode by reducing a voltage difference between the sustain electrode and the scan electrode during the address period.

In the sustain period, sustain waveforms (sus) forming a positive waveform are alternately applied to the scan electrode and the sustain electrode. As a wall voltage within the cells and a voltage of the sustain waveform are added, a sustain discharge, i.e., a display discharge is generated between the scan electrode and the sustain electrode in cells selected by the address discharge whenever the sustain waveform is applied.

After the sustain discharge is completed, in the erase period, an erase waveform (Ramp-ers) having a narrow pulse width and a low voltage level is applied to the sustain electrode, thereby erasing wall charges remaining within the cells of the entire screen. Wall charges that are distributed within the discharge cells by the driving waveform according to a first embodiment of the present invention will be described with reference to FIG. 5*b*.

Figure 5B:
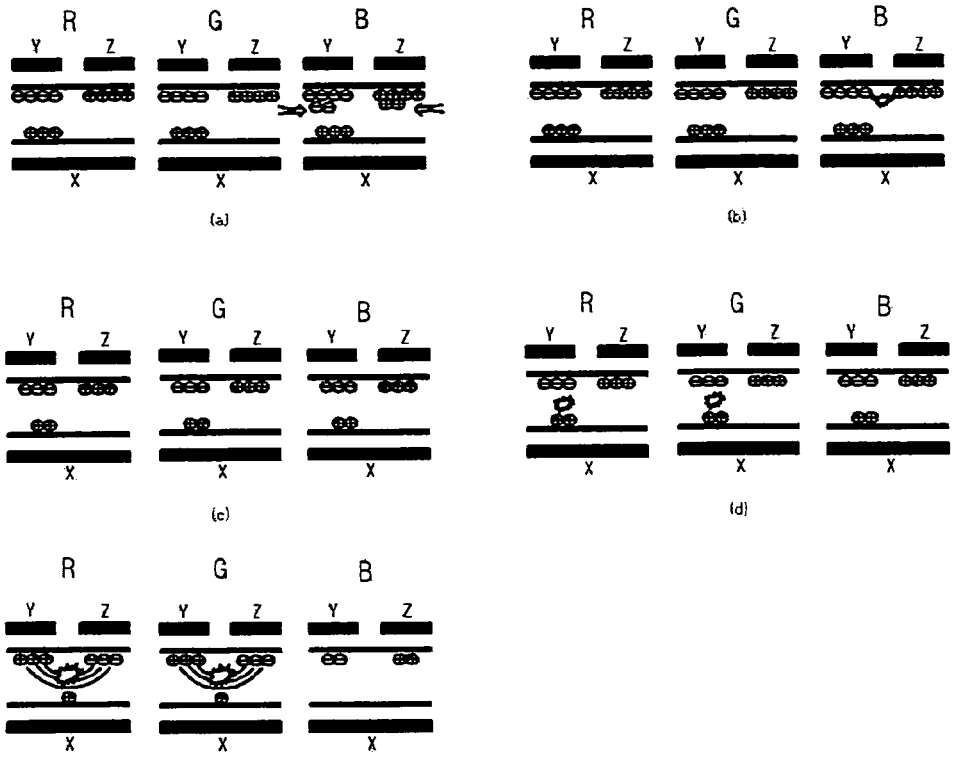
FIG. 5*b* illustrates wall charges distributed within a discharge cell according to a first embodiment of the present invention.

FIG. 5*b* illustrates wall charges distributed within discharge cells according to a first embodiment of the present invention.

Referring to FIG. 5*b*, in the set-up period of the reset period, the set-up waveform is applied to the scan electrode Y and a waveform of a voltage level that is relatively lower than that of the set-up waveform is applied to the sustain electrode Z and the address electrodes X. Therefore, as shown in (a) of FIG. 5*b*, negative charges are located on the scan electrode Y and positive charges are located on the sustain electrode Z and the address electrode X.

In R, G and B unit pixels, the R cell and the G cell remain turned on and the B cell remains off, thus forming a monochromatic pattern. Charged particles diffused from adjacent R and G cells that remain on are transferred to the B cell that remains off.

Thereafter, in the application period of the first falling waveform, the first falling waveform is supplied to the scan electrode Y and a positive waveform of a voltage level lower than that of the sustain voltage is supplied to the sustain electrode Z. Therefore, as shown in (b) of FIG. 5*b*, an erase discharge is generated between the scan electrode Y and the sustain electrode Z in the B cell in which wall charges are excessively formed.

In the set-down period, the second falling waveform whose lowest voltage level is lower than that of the first falling waveform is supplied to the scan electrode Y. A predetermined bias voltage, preferably, a waveform of the ground (GND) level is also applied to the sustain electrode Z and the address electrode X and is then kept therein. Therefore, as shown in (c) of FIG. 5*b*, wall charges formed in the set-up period are partially erased. Through this erase process, distribution of wall charges within each discharge cell becomes uniform.

In the address period, an address discharge is generated by the scan waveform supplied to the scan electrode Y and the address waveform supplied to the address electrode X, as shown in (d) of FIG. 5*b*.

In the sustain period, an alternating sustain waveform is applied to the scan electrode Y and the sustain electrode Z at least once, so that a sustain discharge is generated as shown in (e) of FIG. 5*b*.

Figure 6:
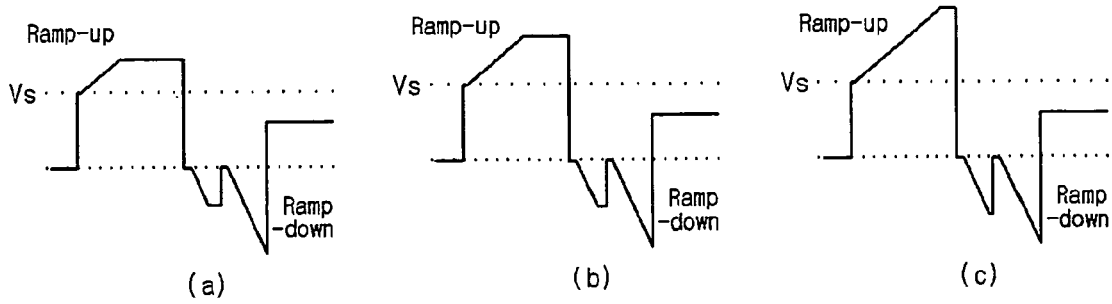
FIG. 6 shows a waveform for illustrating the relation between a set-up waveform and a first falling waveform according to a first embodiment of the present invention.

FIG. 6 shows a waveform for illustrating the relation between a set-up waveform and a first falling waveform according to a first embodiment of the present invention.

As shown in FIG. 6, in a first embodiment of the present invention, the highest voltage level of the set-up waveform applied to the scan electrode can be controlled, if appropriate. The highest voltage level of the set-up waveform applied to the scan electrode can be controlled on a frame basis temporally, or on a sub-field basis. Furthermore, the highest voltage level of the set-up waveform applied to the scan electrode can be controlled on a scan electrode line basis spatially. The higher the highest voltage level of the set-up waveform, the greater the amount of wall charges formed in the discharge cells. The amount of wall charges formed in the discharge cells is saturated over a predetermined voltage level.

In a first embodiment of the present invention, the lowest voltage level of the first falling waveform is controlled according to the highest voltage level of the set-up pulse considering the amount of wall charges, which is increased as the highest voltage level becomes high, as described above. As shown in (a) to (c), the lowest voltage level of the first falling waveform decreases as the highest voltage level of the set-up waveform increases so that wall charges between the scan electrode and the sustain electrode can be sufficiently erased.

Figure 7:
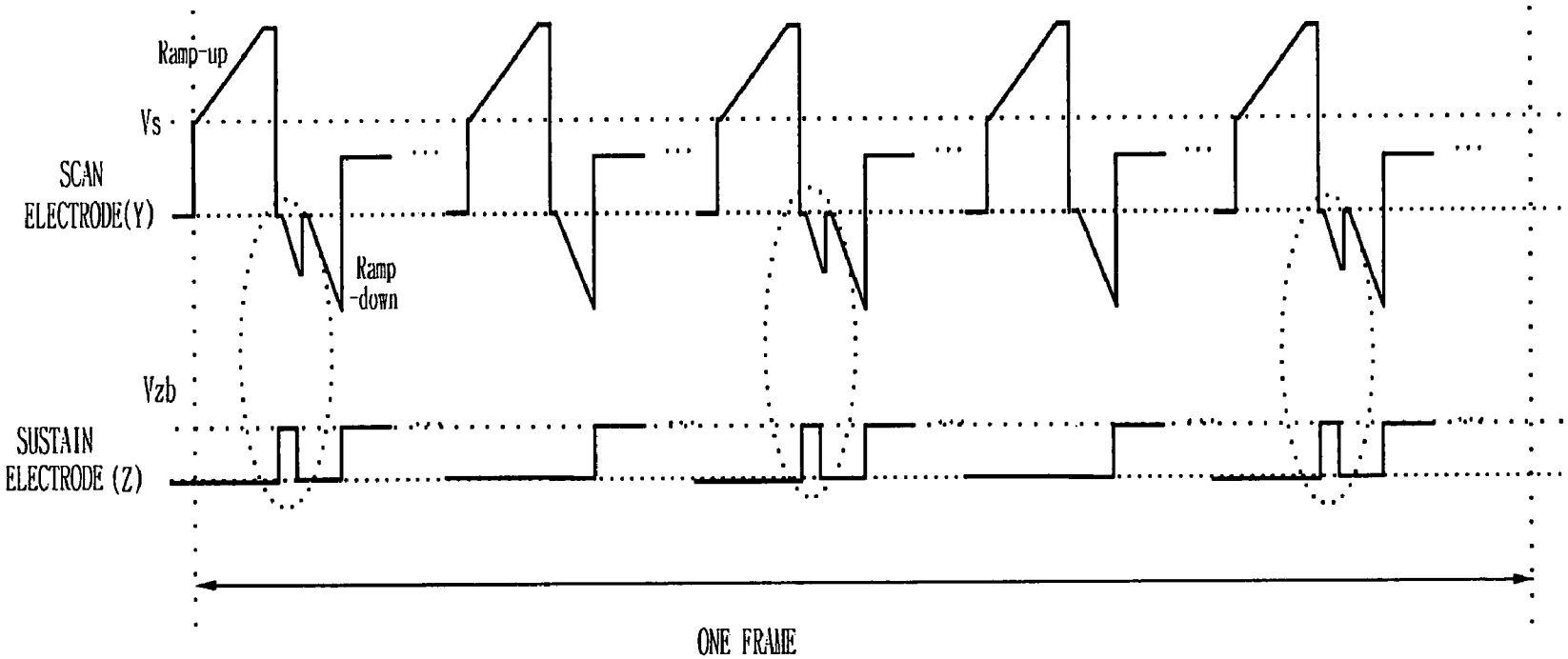
FIG. 7 is a waveform diagram for illustrating another waveform of the plasma display apparatus according to a first embodiment of the present invention.

FIG. 7 is a waveform diagram for illustrating another waveform of the plasma display apparatus according to a first embodiment of the present invention.

As shown in FIG. 7, a first falling waveform according to a first embodiment of the present invention is applied to at least one sub-field during one frame. If the first falling waveform is included in the entire sub-fields during one frame, it is efficient to prevent an afterimage erroneous discharge. However, an application time of other waveforms is relatively shortened due to a temporal limit.

For example, in the case where a sustain period indicating a sustain discharge light, i.e., actual display light is to be reduced, luminance of a screen that is being display decreases and contrast decreases. In view of the above, in a first embodiment of the present invention, the number of first falling waveforms applied on a frame basis is decided by taking two factor (to overcome temporal limit and prevent an afterimage erroneous discharge) into consideration.

Figure 8:
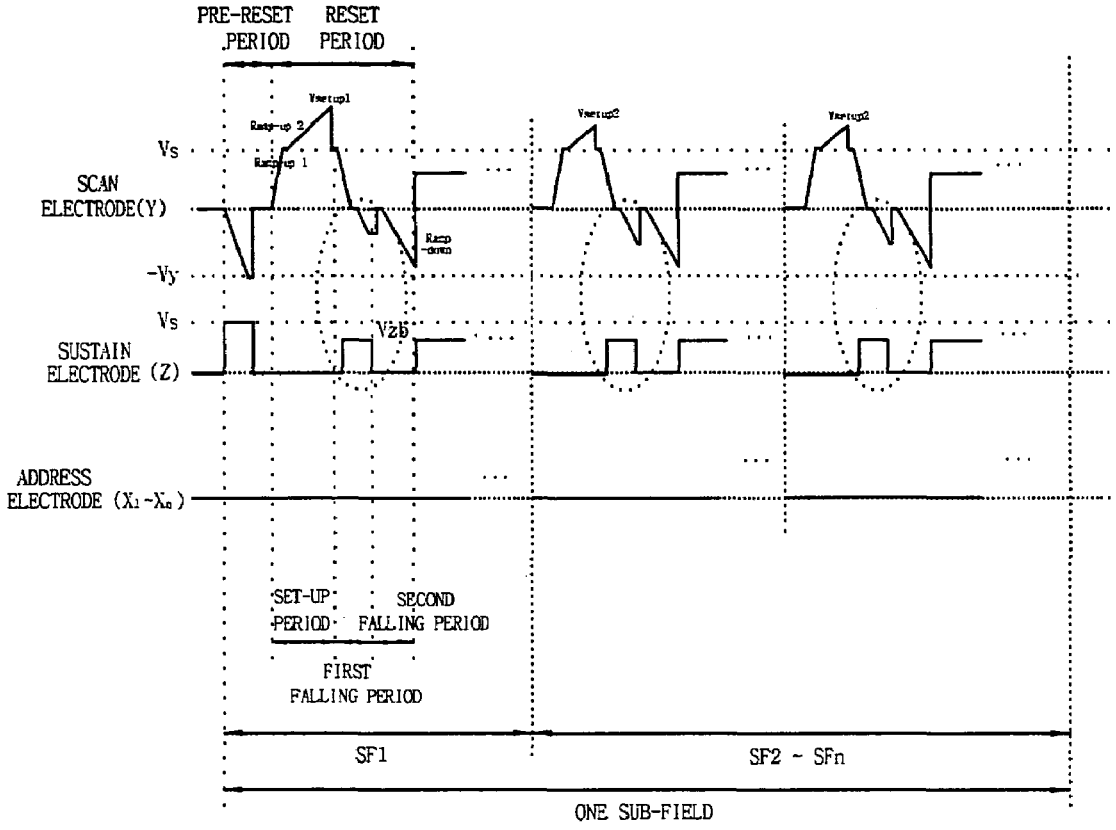
FIG. 8 is a waveform diagram for illustrating another waveform of the plasma display apparatus according to a first embodiment of the present invention.

FIG. 8 is a waveform diagram for illustrating another waveform of the plasma display apparatus according to a first embodiment of the present invention.

As shown in FIG. 8, a modified waveform according to a first embodiment of the present invention comprises a pre-reset period in which a positive waveform is applied to any one of the sustain electrodes and an inverse waveform of a positive waveform is applied to the remaining electrodes, before the reset period.

For example, in the pre-reset period, a negative waveform that gradually falls is applied to the scan electrode and a positive waveform of the sustain voltage (Vs) is applied to the sustain electrode. Furthermore, 0V of the ground (GND) level voltage is applied to the address electrode. In all of the discharge cells, a dark discharge is generated between the scan electrode and the sustain electrode and between the sustain electrode and the address electrodes. Therefore, wall charges are formed on all of the discharge cells.

As a pre-reset waveform is applied before a reset period of a first sub-field every frame, all of the discharge cells are initialized while having the same wall charge distribution. Since a stabilized wall charge state can be secured through the pre-reset period, the highest voltage level of a set-up waveform of each sub-field can be lowered during one frame. As the highest voltage level decreases, the set-up period can be reduced and a sufficient driving margin can be secured accordingly.

In the set-up period of the reset period, a first positive ramp (Ramp-up 1) waveform and a second positive ramp (Ramp-up 2) waveform are consecutively applied to the scan electrodes. 0V is applied to the sustain electrode and the address electrode. A voltage of the first positive ramp (Ramp-up 1) waveform rises from 0V to a positive sustain voltage (Vs) level and a voltage of the second positive ramp (Ramp-up 2) waveform rises from the positive sustain voltage (Vs) level to the highest voltage (Vsetup 1 or Vsetup 2) level higher than the positive sustain voltage (Vs) level. Through the set-up period, wall charges are accumulated on all of the discharge cells.

In a first embodiment of the present invention, the highest voltage (Vsetup 1) level of a set-up waveform of a first sub-field (SF1) applied to the scan electrode is different from the highest voltage (Vsetup 2) level of a set-up waveform of the remaining sub-fields (SF2 to SFn). Preferably, the highest voltage (Vsetup 1) level of the first sub-field (SF1) can be set to be higher than the highest voltage (Vsetup 2) level of the remaining sub-fields (SF2 to SFn). Therefore, in the first sub-field (SF1) subsequent to the pre-reset period, the highest voltage level of the set-up waveform is set to be higher than the voltage level of the remaining sub-fields (SF2 to SFn) to secure the same wall charge distribution as the wall charge distribution of the remaining sub-fields (SF2 to SFn).

After the set-up period, a negative first falling waveform, which falls to the ground (GND) level voltage lower than the highest voltage level of the set-up waveform and then gradually falls, is applied to the scan electrode. As a positive waveform is applied to the sustain electrode Z in synchronization with the first falling waveform, a weak erase discharge is generated between the scan electrode and the sustain electrode.

In the driving waveform comprising the pre-reset period according to a first embodiment of the present invention, the lowest voltage level of the first falling waveform of the first sub-field (SF1) is different from the lowest voltage level of the first falling waveform of the remaining sub-fields (SF2 to SFn). The amount of the wall charges of the first sub-field (SF1) after the set-up period is less than the amount of the wall charges of the remaining sub-fields (SF2 to SFn) and the remaining sub-fields (SF2 to SFn) have some amount of wall charges, under the influence of the pre-reset waveform. That is, the first falling waveform of the first sub-field (SF1) is controlled so that a weak erase discharge is generated. The first falling waveform of the remaining sub-fields (SF2 to SFn) is controlled so that a strong erase discharge is generated compared with the first sub-field.

Preferably, the lowest voltage level of the first falling waveform of the first sub-field (SF1) is applied from −110V to −100V on the basis of the ground (GND) level. The lowest voltage level of the first falling waveform of the remaining sub-fields (SF2 to SFn) is applied from −140V to −100V.

If the lowest voltage level of the first falling waveform of the first sub-field (SF1) is less than −110V and the lowest voltage level of the first falling waveform of the remaining sub-fields (SF2 to SFn) is less than −140V, an erase discharge is excessively generated between the scan electrode and the sustain electrode, so that a dark afterimage appears. If the lowest voltage level of the first falling waveform of the first sub-field (SF1) exceeds −110V, an erase discharge is not generated between the scan electrode and the sustain electrode.

Furthermore, to secure an appropriate erase discharge period, a width of the first falling waveform of the first sub-field (SF1) can be preferably set in the range of 10 μs to 20 μs and a width of the first falling waveform of the remaining sub-fields (SF2 to SFn) can be preferably set in the range of 20 μs to 30 μs.

The set-down period of the reset period, the address period and the sustain period have been sufficiently described with reference to FIG. 5*a*. Description thereof will be omitted.

As described above, wall charges, which are excessively accumulated on cells that remain off in a region indicating a monochromatic pattern upon driving, are selectively erased through the first falling waveform. It is thus possible to improve a spot problem more efficiently.

Furthermore, while the first falling waveform is applied, a voltage level lower than the sustain voltage (Vs), e.g., Vzb is used as a voltage level of a positive waveform in the sustain electrode. Upon implementation of images, a distortion phenomenon will be prevented. In addition, by limiting the lowest voltage level of the first falling waveform, a problem in which a complementary afterimage is generated will be prevented.

Second Embodiment

Figure 9:
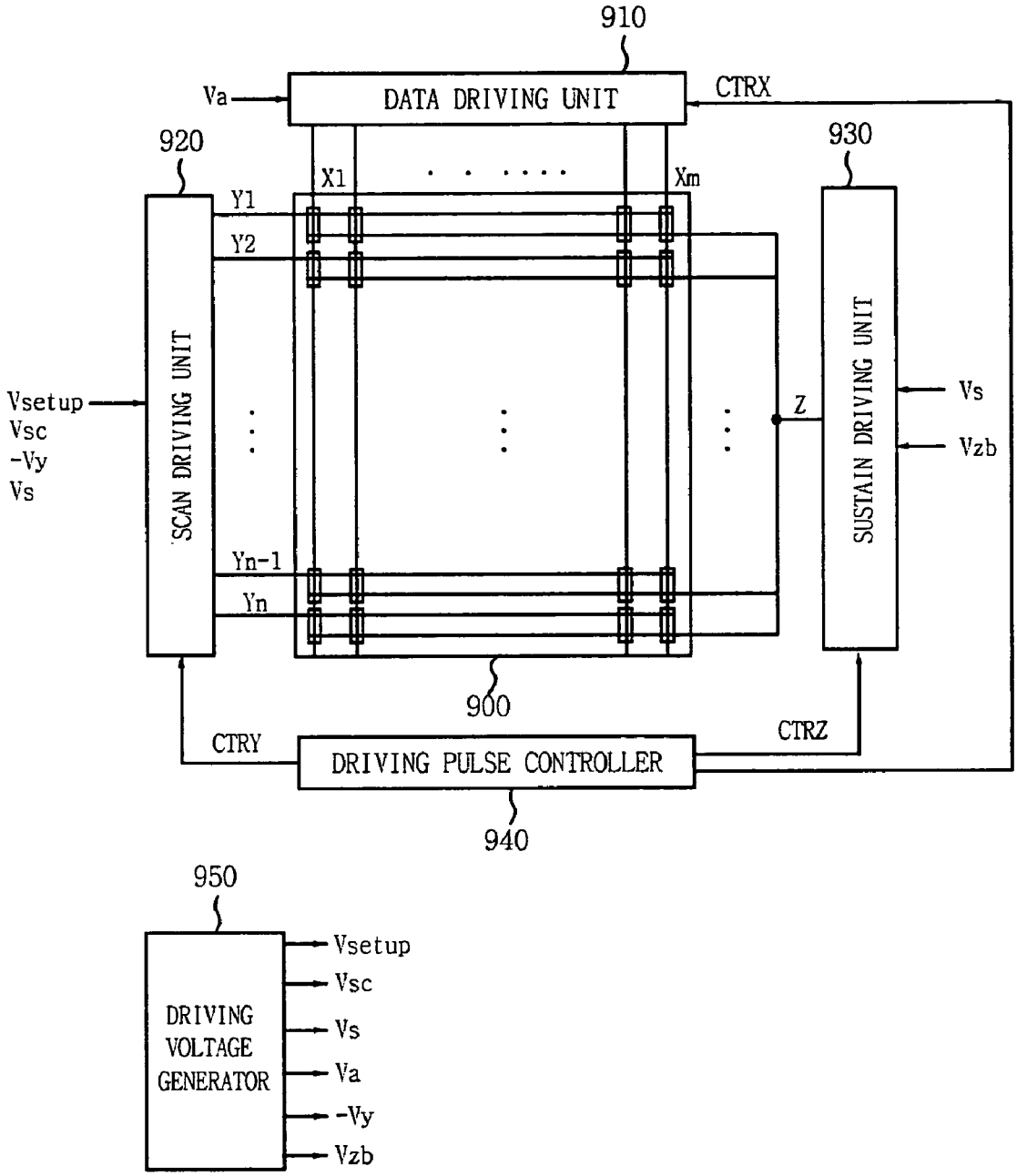
FIG. 9 is a block diagram showing the construction of a plasma display apparatus according to a second embodiment of the present invention.

FIG. 9 is a block diagram showing the construction of a plasma display apparatus according to a second embodiment of the present invention.

As shown in FIG. 9, the plasma display apparatus according to a second embodiment of the present invention comprises a plasma display panel 900, a data driver 910, a scan driver 920, a sustain driver 930, a driving pulse controller 940 and a driving voltage generator 950.

The constituting elements of the plasma display apparatus according to a second embodiment of the present invention; the plasma display panel 900, the data driver 910, the scan driver 920 and the driving voltage generator 950 have the same functions as those of the plasma display panel 400, the data driver 410, the scan driver 420 and the driving voltage generator 450, which have been described with reference to FIG. 4 according to the first embodiment of the present invention. Description thereof will be omitted.

Operating characteristics of the sustain driver 430 that is operated under the control of the driving pulse controller 440 according to a first embodiment of the present invention and the sustain driver 930 that is operated under the control of the driving pulse controller 940 according to a second embodiment of the present invention will be described below.

The sustain driver 930 drives the sustain electrode Z, i.e., a common electrode in the plasma display panel 900. The sustain driver 930 according to a second embodiment of the present invention applies a positive pulse to the sustain electrode Z under the control of the driving pulse controller 940 while a first falling pulse is applied. The positive pulse is set to have a voltage level of the degree in which a discharge is not generated, i.e., a voltage level lower than the sustain voltage (Vs). The positive pulse can preferably have voltages shown in the drawing, or the bias voltage (Vzb) applied to the sustain electrode Z during the address period.

In the second embodiment of the present invention, while the first falling pulse is applied, the sustain electrode Z is electrically floated in at least one period. That is, a voltage supply switching element (not shown) of the sustain driver 930, for driving the sustain electrode Z, is opened. The reason why the voltage supply switching element is opened is to reduce hardware load, which occurs as a peaking component is generated in a positive pulse applied to the sustain electrode Z and a positive pulse is modified as an irregular waveform. This will be described in detail later on.

Thereafter, while a second falling pulse is applied, the sustain electrode Z is maintained at the ground (GND) level voltage. During the address period, the bias voltage (Vzb) is applied to the sustain electrodes Z. During the sustain period, at least one or more sustain pulses for a sustain discharge, which are supplied from the ground (GND) level voltage to the sustain voltage (Vs), are supplied to the sustain electrode Z. A driving waveform implemented according to the plasma display apparatus in accordance with a second embodiment of the present invention will be described with reference to FIG. 10.

Figure 10:
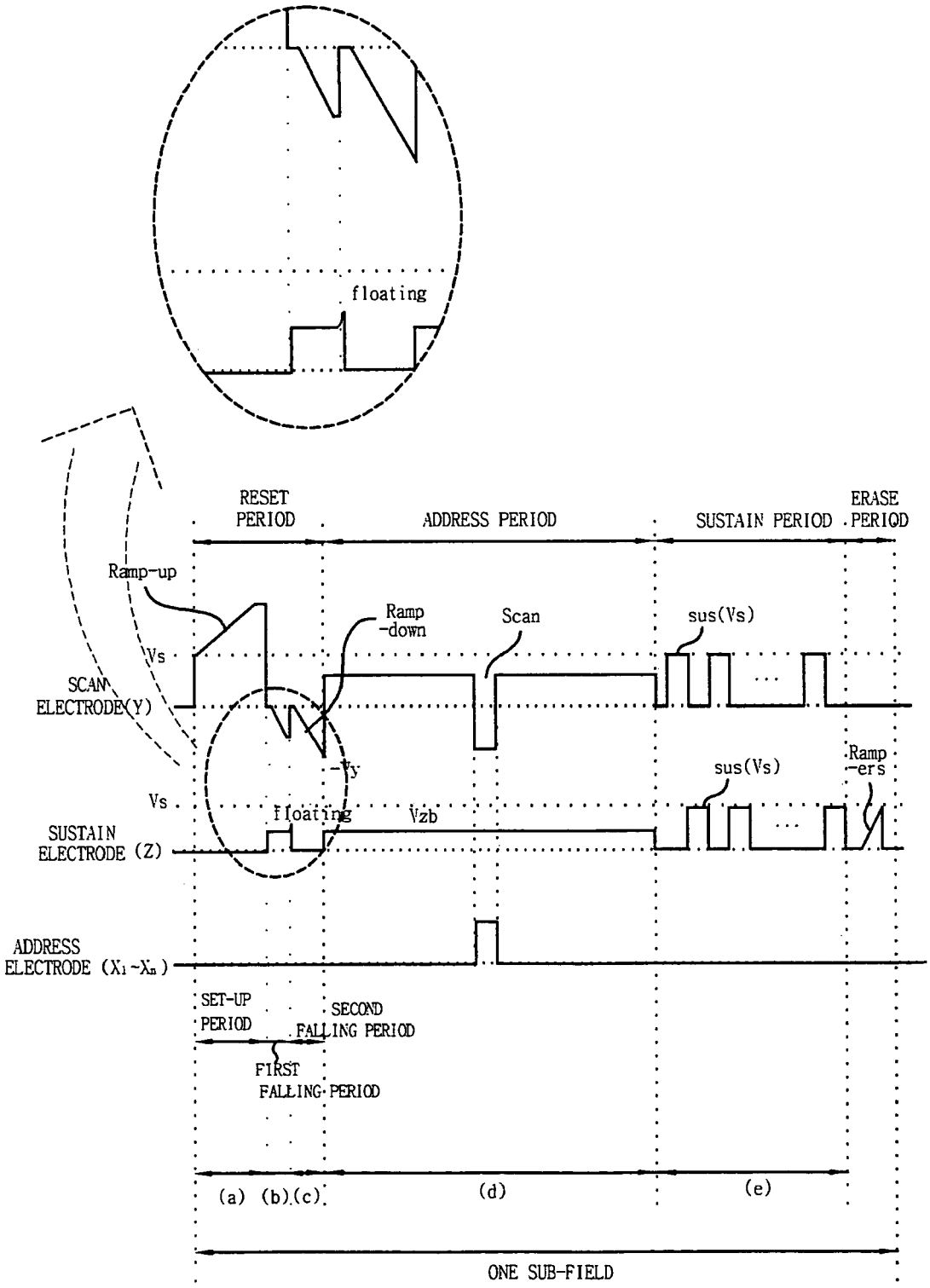
FIG. 10 shows a driving waveform of the plasma display apparatus according to a second embodiment of the present invention.

FIG. 10 shows the driving waveform of the plasma display apparatus according to a second embodiment of the present invention.

As shown in FIG. 10, the plasma display apparatus in accordance with a second embodiment of the present invention is driven with one frame being divided into a reset period for initializing the entire cells, an address period for selecting cells to be discharged, a sustain period for sustaining the discharge of selected cells and an erase period for erasing wall charges within discharged cells.

In the second embodiment of the present invention, there is a high probability that a positive waveform may be influenced by the first falling waveform. For example, there is a high probability that a peaking component may be generated in the positive waveform applied to the sustain electrode under the influence of the first falling waveform that rises from the lowest voltage level of −140V to −100V to the ground (GND) voltage level. The positive waveform is modified as a waveform that is shaken irregularly according to the peaking component. This noise component increases EMI.

In view of the above point, in the technical spirit of the present invention, the sustain electrode is floated in at least one period, i.e., a period in which the first falling waveform is applied and/or a period in which the first falling waveform rises from the lowest voltage level to the ground voltage level. As a result, the sustain electrode has its polarity lost and EMI is less generated. It is thus possible to prevent elements of the driver, for driving the sustain electrode, from being damaged. As the sustain electrode is floated as shown in FIG. 10, the positive waveform becomes a waveform that immediately rises and then falls under the influence of the first falling waveform.

Characteristics of the remaining periods other than the application period of the first falling waveform according to a second embodiment of the present invention are the same as those that have been described with reference to FIG. 5*a* according to a first embodiment of the present invention. Description thereof will be omitted.

A wall charge state that is distributed within the discharge cells by the driving waveform according to a second embodiment of the present invention are also the same as that has been described with reference to FIG. 5*b* according to a first embodiment of the present invention. Description thereof will be omitted.

Characteristics regarding control of a voltage level of the first falling waveform according to a voltage level of the set-up waveform, a first falling waveform applied to at least one sub-field during one frame and a waveform comprising the pre-reset period, which have been described in the first embodiment of the present invention, can be applied to the second embodiment of the present invention.

A more efficient driving method for preventing damage to the circuits of the driver according to a second embodiment of the present invention will be described with reference to FIGS. 11 to 13.

Figure 11:
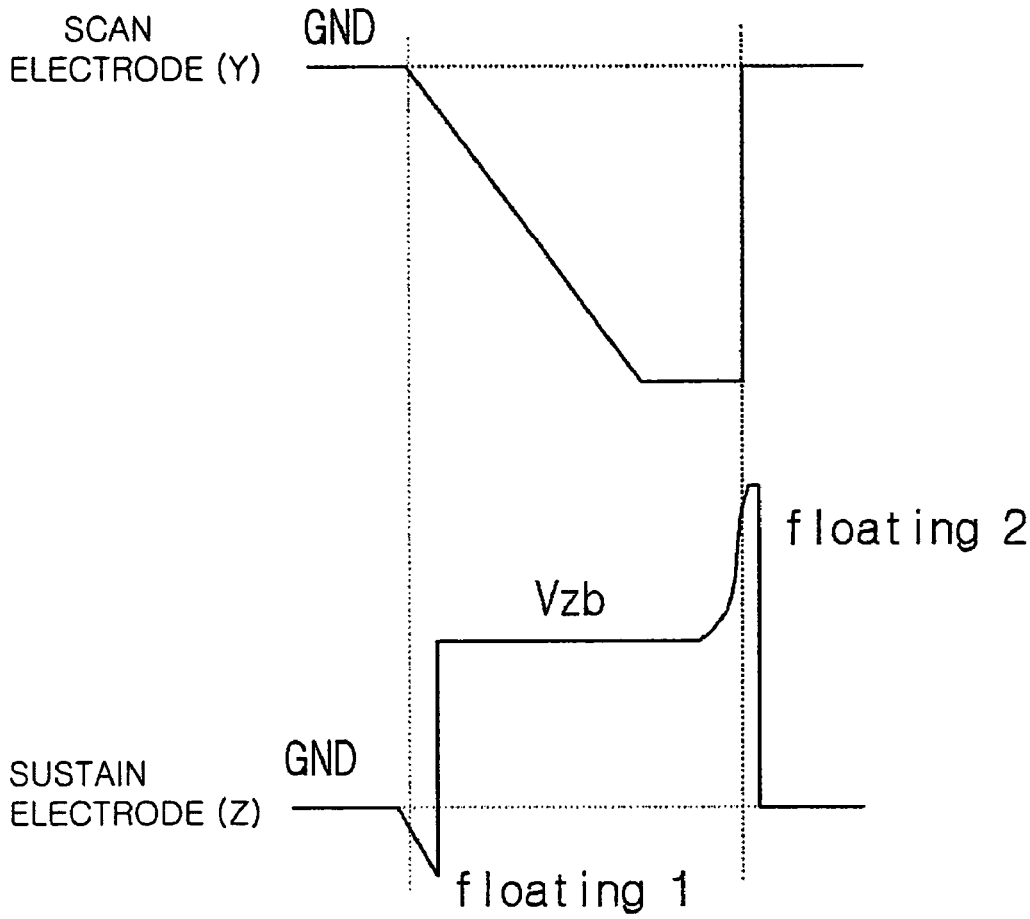
FIG. 11 illustrates another driving waveform of the plasma display apparatus according to a second embodiment of the present invention.

FIG. 11 illustrates another driving waveform of the plasma display apparatus according to a second embodiment of the present invention.

As shown in FIG. 11, in a second embodiment of the present invention, after the sustain electrode is floated (floating 1) before a period in which a first falling waveform is applied, a positive waveform is applied.

Therefore, since the first falling waveform falls and a voltage level abruptly rises from a ground voltage level to a bias voltage (Vzb) level, the generation of a peaking component can be prevented and EMI can be reduced when the positive waveform is applied. It is thus possible to efficiently reduce the load of circuit elements of the sustain driver. As shown in the drawing, the sustain electrode falls under the influence of the first falling waveform, and then rises as a positive voltage is applied. Thereafter, when the first falling waveform rises from the lowest voltage level, the sustain electrode is floated (floating 2).

The set-up period, the set-down period, the address period, the sustain period and the erase period have been described sufficiently with reference to FIG. 5*a*. Description thereof will be omitted for simplicity.

Figure 12:
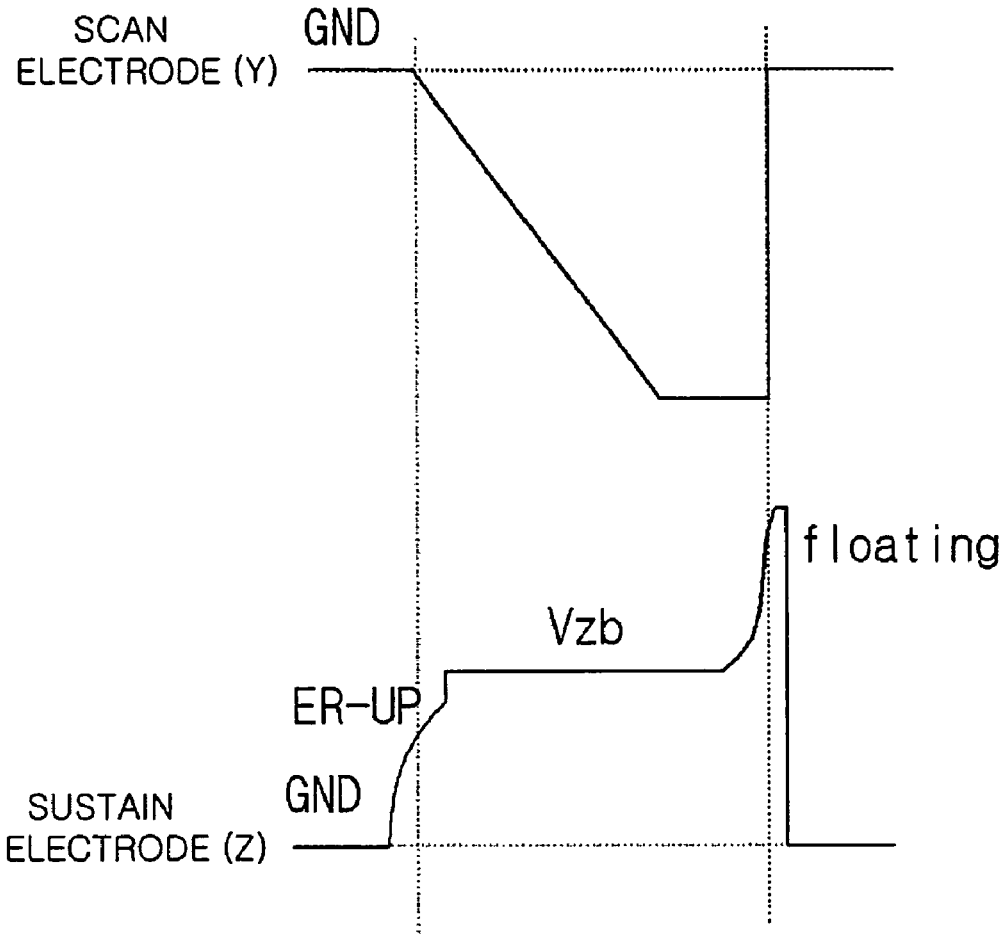
FIG. 12 illustrates further another driving waveform of the plasma display apparatus according to a second embodiment of the present invention.

FIG. 12 illustrates further another driving waveform of the plasma display apparatus according to a second embodiment of the present invention.

As shown in FIG. 12, in further another driving waveform of the plasma display apparatus according to the second embodiment of the present invention, a positive waveform is set to rise by an energy recovery and supply unit (not shown).

The energy recovery and supply unit functions to recover invalid energy, which is generated when the plasma display apparatus is driven, and then supply the recovered energy, if needed. The energy recovery and supply unit comprises a capacitor and an inductor, and supplies a rising waveform that rises at a slope or a falling waveform that falls at a slope, through resonance of the capacitor and the inductor.

As described above, in the second embodiment of the present invention, after a waveform (ER-UP) that rises at a slope is supplied from the energy recovery and supply unit, the positive waveform of the bias voltage (Vzb) level is applied. Therefore, the problems as described with reference to FIG. 6 can be solved. Thereafter, when the first falling waveform rises from the lowest voltage level, the sustain electrode is floated (floating).

The set-up period, the set-down period, the address period, the sustain period and the erase period have been described sufficiently with reference to FIG. 5*a*. Description thereof will be omitted for simplicity.

Figure 13:
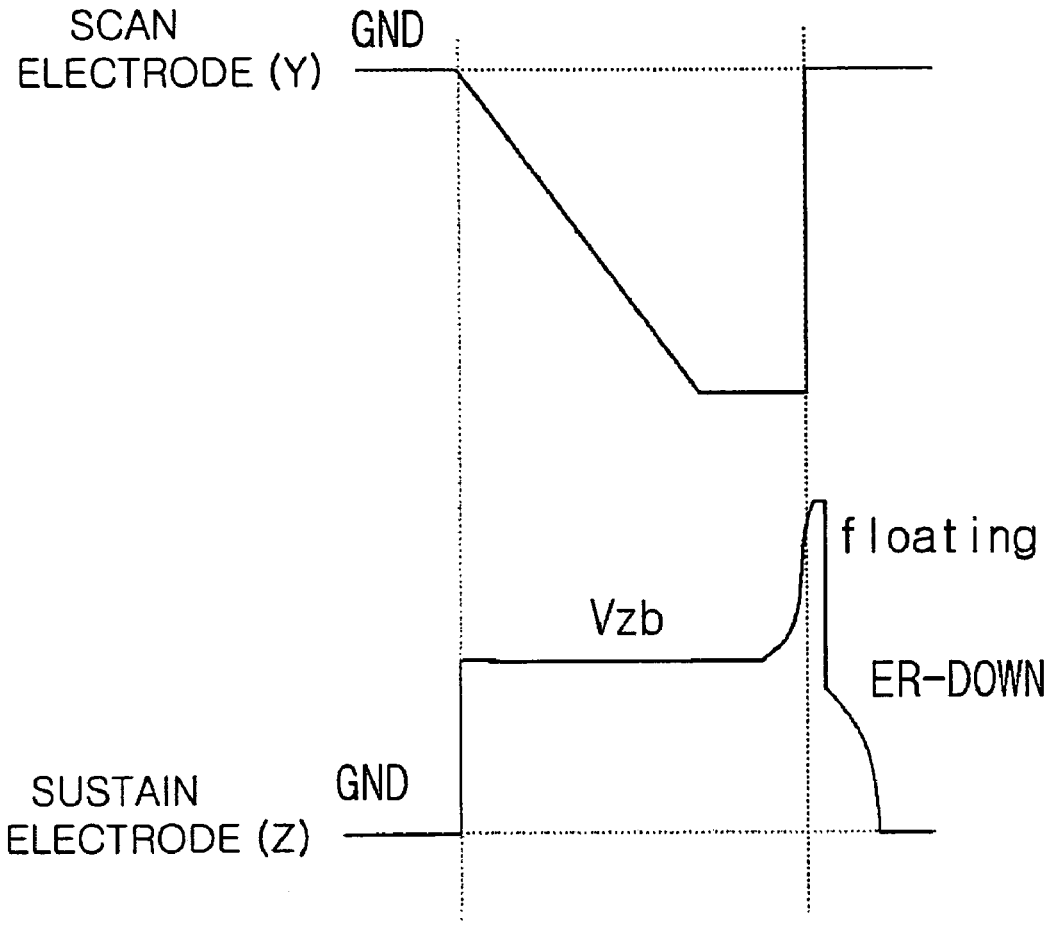
FIG. 13 illustrates further another driving waveform of the plasma display apparatus according to a second embodiment of the present invention.

FIG. 13 illustrates further another driving waveform of the plasma display apparatus according to a second embodiment of the present invention.

As shown in FIG. 13, in further another driving waveform of the plasma display apparatus according to a second embodiment of the present invention, after a sustain electrode is floated (floating), a positive waveform is set to fall by an energy recovery and supply unit (not shown). That is, when energy is recovered by the energy recovery and supply unit, a falling waveform (ER-DOWN) that falls at a slope is supplied to a sustain electrode. Therefore, circuit elements of a driver can be protected effectively. Though not shown in FIG. 13, when a positive waveform is applied to the sustain electrode, at least one or more of the methods described with reference to FIGS. 11 and 12, i.e., the method of floating the sustain electrode and the method using the energy recovery and supply unit can be properly combined.

As described above, in the second embodiment of the present invention, a spot problem will be improved through a first falling waveform. By limiting a voltage level of the first falling waveform, a problem in which a complementary after-image is generated will be prevented. Furthermore, hardware load will be reduced by floating a sustain electrode in at least one period.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus, comprising:

a plasma display panel in which a plurality of sustain electrode pairs comprising scan electrodes and sustain electrodes is formed;

a driver for driving the sustain electrode pairs; and a driving pulse controller that controls the driver to sequentially apply first and second falling waveforms to the scan electrodes during a reset period, wherein a highest voltage level of the second falling waveform is higher than a lowest voltage level of the first falling waveform, wherein the lowest voltage level of the first falling waveform and a lowest voltage level of the second falling waveform have a negative polarity.

2. The plasma display apparatus as claimed in claim 1, wherein the lowest voltage levels of the first falling waveform and the second falling waveform are different from each other.

3. The plasma display apparatus as claimed in claim 2, wherein the lowest voltage level of the first falling waveform is higher than the lowest voltage level of the second falling waveform.

4. The plasma display apparatus as claimed in claim 1, wherein, during the reset period, the lowest voltage level of the first falling waveform is controlled according to a highest voltage level of a set-up waveform applied to the scan electrodes.

5. The plasma display apparatus as claimed in claim 1, wherein the lowest voltage level of the first falling waveform is set in a range of −140V to −100V.

6. The plasma display apparatus as claimed in claim 1, wherein a width of the first falling waveform is set in a range of 10 μs to 30 μs.

7. The plasma display apparatus as claimed in claim 1, wherein the first falling waveform is supplied from a same voltage source used to provide a voltage level of the second falling waveform.

8. The plasma display apparatus as claimed in claim 1, wherein the first falling waveform is supplied in at least one sub-field.

9. The plasma display apparatus as claimed in claim 1, wherein prior to the reset period, a positive waveform is applied to any one of the sustain electrode pairs, and a waveform having an opposite waveform to the positive waveform is applied to the remaining electrodes of the sustain electrode pairs.

10. The plasma display apparatus as claimed in claim 9, wherein the lowest voltage level of the first falling waveform in a sub-field comprising the pre-reset period is different from the voltage level in at least one of the remaining sub-fields.

11. The plasma display apparatus as claimed in claim 9, wherein a highest voltage level of a set-up waveform in a sub-field comprising the pre-reset period is different from a voltage level in at least one of the remaining sub-fields.

12. The plasma display apparatus as claimed in claim 1, wherein the second falling waveform falls from a same voltage level as the first falling waveform.

13. The plasma display apparatus as claimed in claim 12, wherein the same voltage level is a ground (GND) level voltage.

14. The plasma display apparatus as claimed in claim 1, wherein the driving pulse controller controls the sustain electrodes to be floated in at least one period.

15. The plasma display apparatus as claimed in claim 14, wherein the at least one period is a period where the first falling waveform changes from a ground voltage level to the lowest voltage level or a period where the first falling waveform changes from the lowest voltage level to the ground voltage level.

16. The plasma display apparatus as claimed in claim 1, wherein the driving pulse controller controls the driver to apply a positive waveform having a voltage level lower than a voltage level of a sustain waveform to the sustain electrodes while the first falling waveform is applied.

17. The plasma display apparatus as claimed in claim 16, wherein the positive waveform has a same voltage level as that of a bias voltage applied to the sustain electrodes during an address period.

18. The plasma display apparatus as claimed in claim 16, wherein the voltage level of the positive waveform is set in the range of 80 V to 100V.

19. The plasma display apparatus as claimed in claim 1, wherein the driver includes a first driver for driving the scan electrodes and a second driver for driving the sustain electrodes.

20. A plasma display apparatus, a plasma display panel in which a plurality of sustain electrode pairs comprising scan electrodes and sustain electrodes is formed;

a driver for driving the sustain electrode pairs; and a driving pulse controller that controls the driver to sequentially apply first and second falling waveforms to the scan electrodes during a reset period, wherein a highest voltage level of the second falling waveform is higher than a lowest voltage level of the first falling waveform, wherein an absolute value of the lowest voltage level of the first failing waveform is set to be less than 70 % of a lowest voltage level of the second falling waveform.

21. A plasma display apparatus, a plasma display panel in which a plurality of sustain electrode pairs comprising scan electrodes and sustain electrodes is formed;

a driver for driving the sustain electrode pairs; and a driving pulse controller that controls the driver to sequentially apply first and second falling waveforms to the scan electrodes during a reset period, wherein a highest voltage level of the second falling waveform is higher than a lowest voltage level of the first falling waveform, wherein while the second falling waveform is supplied, the sustain electrodes are maintained at a ground (GND) level voltage.

* * * * *